US007654872B2

(12) United States Patent
Lin et al.

(10) Patent No.: US 7,654,872 B2
(45) Date of Patent: Feb. 2, 2010

(54) AUDIO JACK CONNECTOR

(75) Inventors: Kuo-Chin Lin, Taipei Hsien (TW); Bo Liu, Taipei Hsien (TW); Feng Zhu, Taipei Hsien (TW)

(73) Assignee: Cheng Uei Precision Industry Co., Ltd., Taipei Hsien (TW)

( * ) Notice: Subject to any disclaimer, the term of this patent is extended or adjusted under 35 U.S.C. 154(b) by 396 days.

(21) Appl. No.: 11/757,258

(22) Filed: Jun. 1, 2007

(65) Prior Publication Data

US 2008/0299835 A1 Dec. 4, 2008

(51) Int. Cl.
*H01R 24/04* (2006.01)

(52) U.S. Cl. ..... 439/668; 439/944

(58) Field of Classification Search ..... 439/668, 439/669, 188, 944, 733.1
See application file for complete search history.

(56) References Cited

U.S. PATENT DOCUMENTS 6,312,274 B1 * 11/2001 Lin ..... 439/188
6,690,801 B2 * 2/2004 Yeh ..... 381/77
D555,099 S * 11/2007 Lin et al. ..... D13/133
7,371,125 B2 * 5/2008 McHugh et al. ..... 439/668

* cited by examiner

*Primary Examiner*—Hae Moon Hyeon
(74) *Attorney, Agent, or Firm*—WPAT, P.C.; Anthony King; Kay Yang

(57) ABSTRACT

An audio jack connector includes a housing and a terminal group. The housing has an insertion hole extending inward from the front of the housing. The bottom of the base defines at least one signal terminal recess and an auxiliary terminal recess, a first aperture is defined in the bottom of the auxiliary terminal recess and communicates with the signal terminal recess. The terminal group has at least one signal terminal and an auxiliary terminal received in the signal terminal recess and the auxiliary terminal recess respectively. The signal terminal has a contact portion projecting into the insertion hole and an elastic portion extending from the end of the contact portion. The auxiliary terminal has a transverse fixed portion and a first connecting portion extending upward and then longitudinally from one end of the fixed portion. One part of the first connecting portion is jammed in the first aperture, and the other part of the first connecting portion projects into the signal terminal recess.

5 Claims, 6 Drawing Sheets

AUDIO JACK CONNECTOR

BACKGROUND OF THE INVENTION

1. Field of the Invention

The present invention relates to a connector, and more particularly to an audio jack connector for transmitting audio signals.

2. The Related Art

An audio jack connector for transmitting audio signals includes a housing and a set of terminals received in the housing. A mating portion extends from one end of the housing with an insertion hole being defined thereof and extending inward along an axis direction. The set of terminals include signal terminals and stationary terminals received in the housing. Moreover, each signal terminals has an elastic arm and a contact portion extending from the end of the elastic arm.

However, when a plug is inserted into the insertion hole, the plug forces the signal terminals to disengage from the initial position. Deformation of the elastic arm of the signal terminals may overstep the bounds of the elastic arm. The elastic arm can't return to the original condition and the contact portion can't return to initial position. So, the signal terminals can't provide enough elastic force to transmit audio signals. It is thus desirable to have an audio jack connector with a strong structure capable of effectively mating with the signal terminals to overcome the problem encountered with the previous art.

SUMMARY OF THE INVENTION

An object of the present invention is to provide an audio jack connector including a housing and a terminal group received in the housing. The housing has a base and a cambered ridge extending upward from the middle of the base, an insertion hole extends inward from the front of the housing along an axis direction of the housing and is defined between the base and the cambered ridge. The bottom of the base defines at least one signal terminal recess and an auxiliary terminal recess, a first aperture is defined in the bottom of the auxiliary terminal recess and communicates with the signal terminal recess. The terminal group has at least one signal terminal and an auxiliary terminal received in the signal terminal recess and the auxiliary terminal recess respectively. The signal terminal has a contact portion that projects into the insertion hole and an elastic portion extending from the end of the contact portion. The auxiliary terminal has a transverse fixed portion and a first connecting portion extending upward from the end of the fixed portion which is near to signal terminal recess and then forward. One part of the first connecting portion is jammed in the first aperture, the other part of the first connecting portion projects into the signal terminal recess and is near to the outside of the elastic portion for being against the elastic portion.

As described above, the elastic portion contacts and slides along the inside of the first connecting portion of the auxiliary terminal in the process of the insertion of the plug. Therefore, a reliable contacting force is formed between the elastic portion and the first connecting portion, which provides more elastic force between the plug and the signal terminal.

BRIEF DESCRIPTION OF THE DRAWINGS

The present invention will be apparent to those skilled in the art by reading the following description of a preferred embodiment thereof, with reference to the attached drawings, in which.

DETAILED DESCRIPTION OF THE PREFERRED EMBODIMENT

Figure 1:
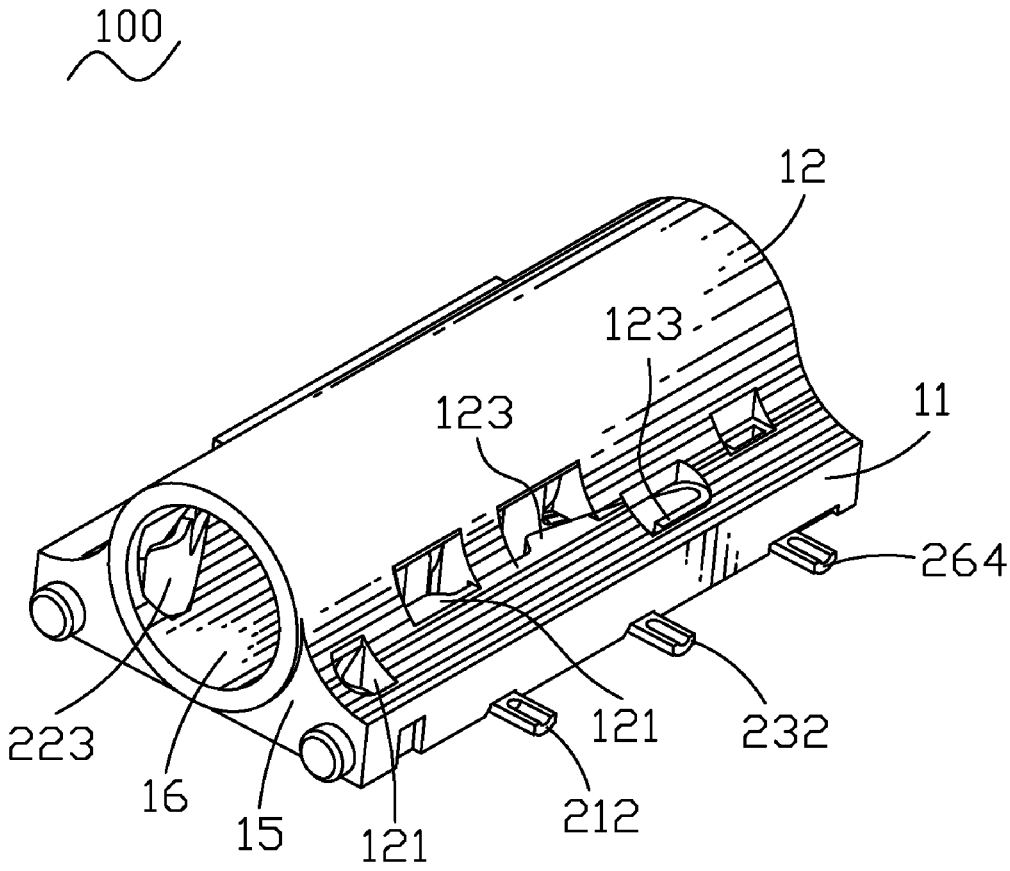
FIG. 1 is a perspective view of an audio jack connector in accordance with the present invention.
Figure 2:
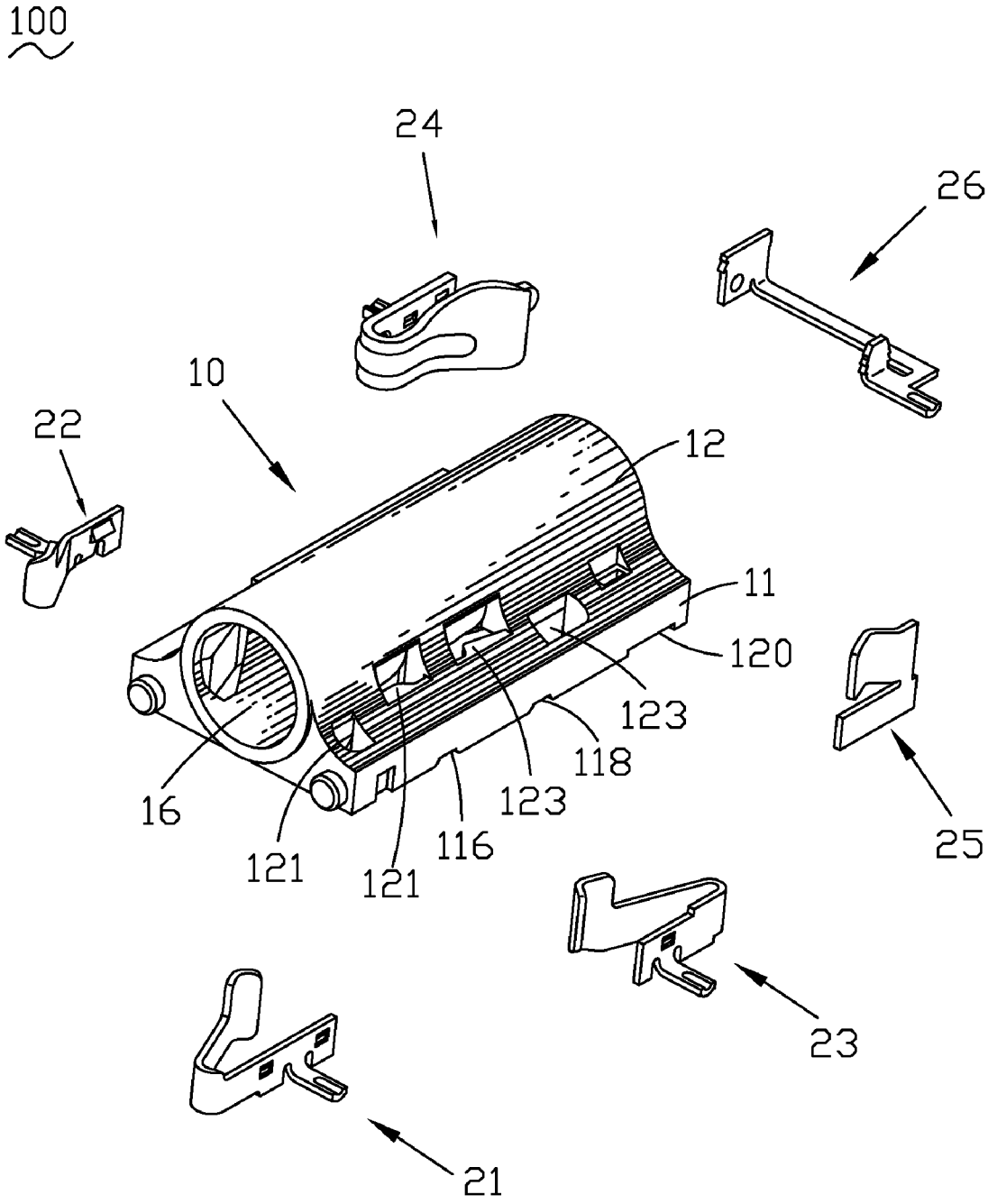
FIG. 2 is an exploded view of the audio jack connector of FIG. 1.

With reference to FIG. 1 and FIG. 2, an audio jack connector 100 includes a housing 10 and a terminal group received in the housing 10. The housing 10 has a base 11 and a cambered ridge 12 extending upward from the middle of the base 11. An insertion hole 16 extending inward from the front of the housing 10 along an axis direction of the housing 10 is defined between the base 11 and the cambered ridge 12.

Figure 3:
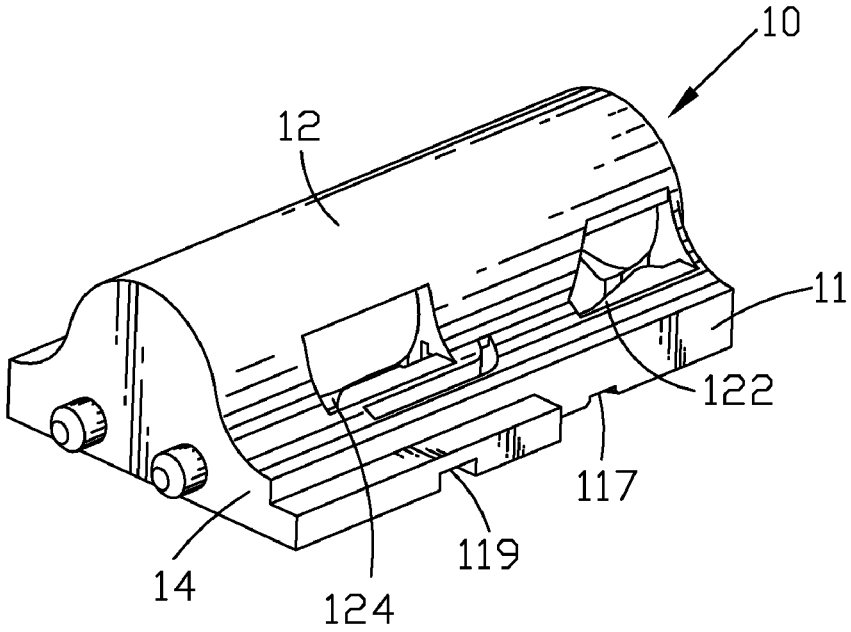
FIG. 3 is a perspective view of a housing of the audio jack connector.
Figure 4:
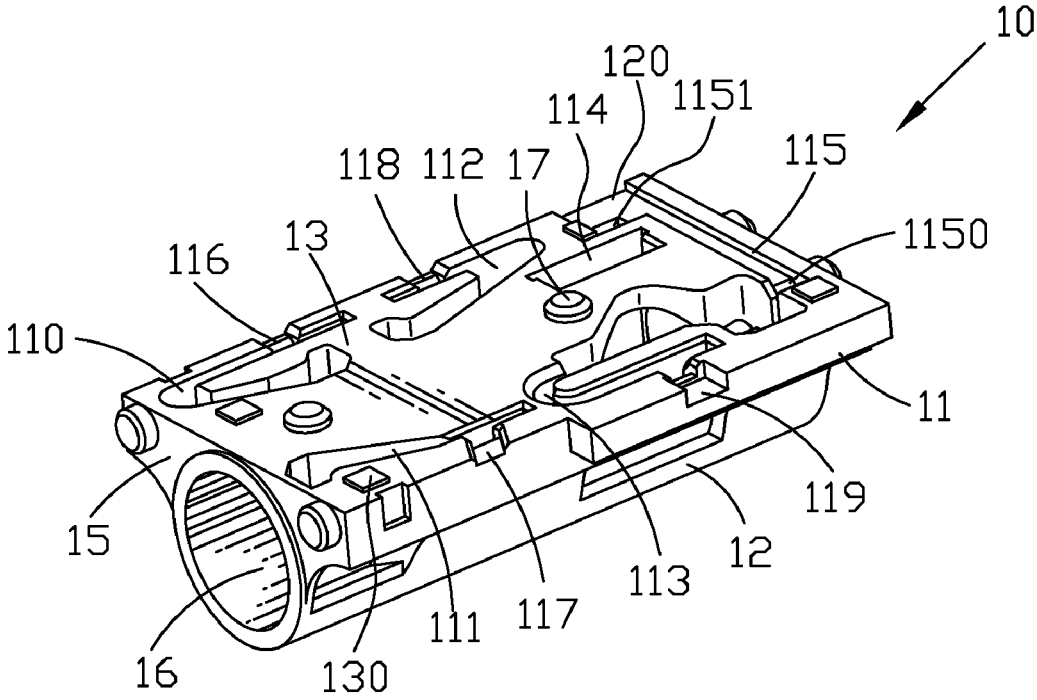
FIG. 4 is another angle perspective view of the audio jack connector shown in FIG. 3.

Referring to FIG. 3 and FIG. 4, the base 11 which is of rectangular shape and has a bottom wall 13, a back wall 14 and a front wall 15. The bottom wall 13 connects to a printed circuit board (not shown). The bottom wall 13 defines a first recess 110, a second recess 111 and a third recess 112 in the front thereof, and defines a fourth recess 113 and a fifth recess 114 in the back thereof. A sixth recess 115 is defined in the rear edge of the bottom wall 13. The recesses 110, 111, 112, 113, 114, 115 connect to the insertion hole. The first recess 110, the third recess 112, the fifth recess 114 are at one side of the bottom wall 13, and the second recess 111, the fourth recess 113 are at the other side of the bottom wall 13.

Referring to FIG. 3 and FIG. 4 again, the bottom wall 13 has a plurality of location pegs 17 which can be inserted into proper locations of the Printed Circuit Board, and has a plurality of spacers 130 which can contact with the Printed Circuit Board.

Referring to FIG. 2 and FIG. 3, the bottom wall 13 has a first gap 116, a second gap 117, a third gap 118 and a fourth gap 119 which communicate with the first recess 110, the second recess 111, the third recess 112 and the fourth recess 113 recess respectively. Two first perforations 121, two second perforations 122, a third perforation 123, a fourth perforation 124 which pass through the joints of the base 11 and the cambered ridge 12 connect with the first recess 110, the second recess 111, the third recess 112, the fourth recess 113 respectively.

Referring to FIG. 4 again, the sixth recess 115 is L-shaped, which includes a transverse portion and a longitudinal portion extending forward from one end of the transverse portion. The transverse portion is longer than the longitudinal portion, the longitudinal portion communicates with the outside. The sixth recess 115 further includes a first aperture 1150 defined in one end of the bottom of the transverse portion opposite to the longitudinal portion and a second aperture 1151 defined in the bottom of the longitudinal portion. The first aperture 1150 forward communicates with the fourth recess 113

Figure 5:
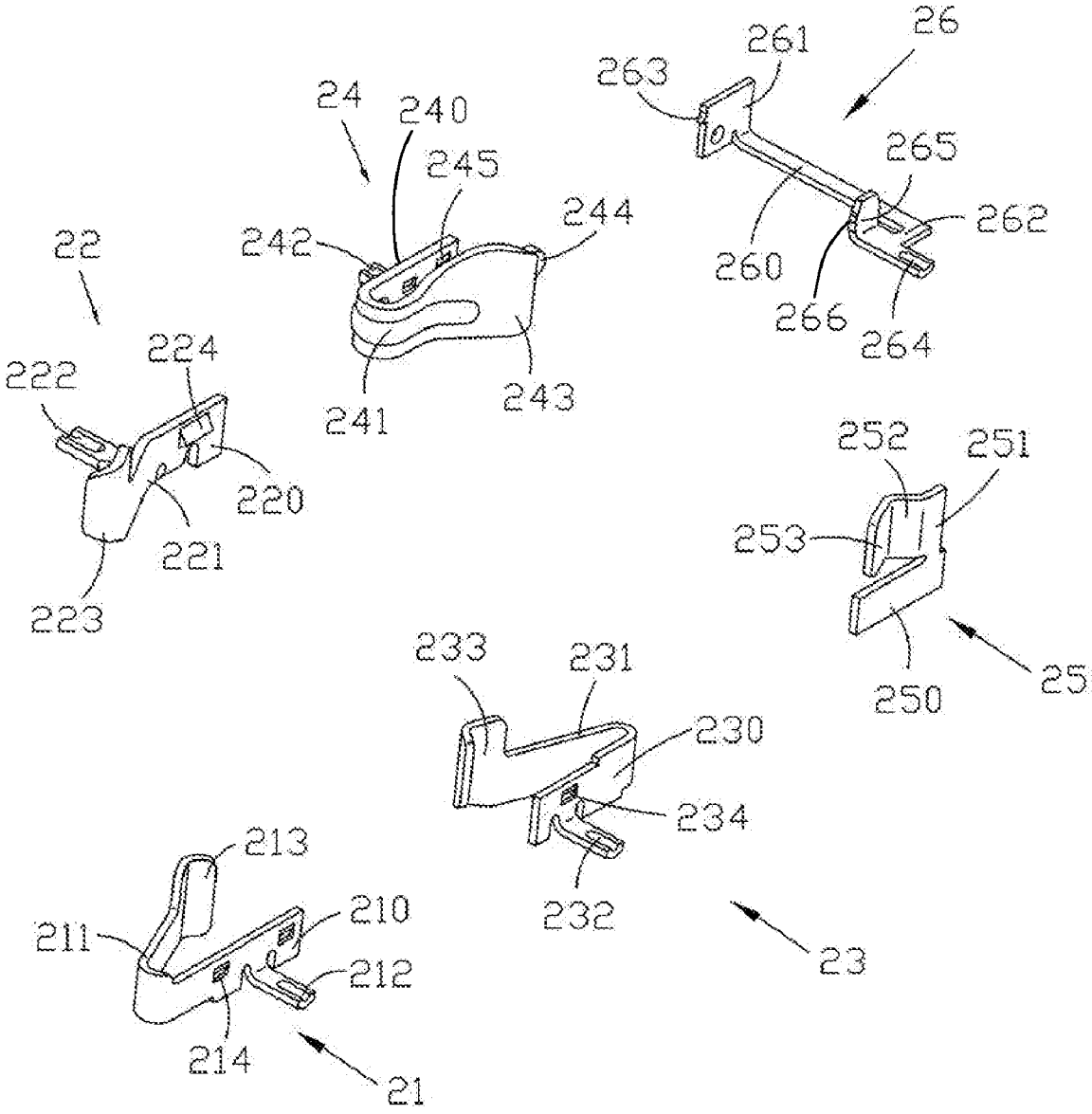
FIG. 5 is a perspective view of a terminal group of the audio jack connector.

Referring to FIG. 5, the terminal group includes a first signal terminal 21, a second signal terminal 22, a third signal terminal 23, a fourth signal terminal 24, a stationary terminal 25 and an auxiliary terminal 26.

The first signal terminal 21 has a first fixed portion 210, a first elastic arm 211 bending inward and then extending rearward from the front of the first fixed portion 210 and a first solder portion 212 extending outward from the bottom of the first fixed portion 210. The first contact portion 213 protrudes inward from the end of the first elastic arm 211. Two first bumps 214 are defined in the corresponding locations of the first fixed portion 210.

The second signal terminal 22 has a second fixed portion 220, a second elastic arm 221 bending inward and extending forward from the front of the second fixed portion 220 and a second solder portion 222 extending outward from the bottom of the second fixed portion 220. A second contact portion 223 protrudes inward from the end of the second elastic arm 222. A second bump 224 is defined in the corresponding location of the second fixed portion 210.

The third signal terminal 23 has a third fixed portion 230, a third elastic arm 231 bending inward and then extending forward from the back of the third fixed portion 230 and a third solder portion 232 extending outward from the bottom of the third fixed portion 230. A third contact portion 233 protrudes inward from the end of the third elastic arm 231. A third bump 234 is defined in the corresponding location of the third fixed portion 230.

The fourth signal terminal 24 has a fourth fixed portion 240, a fourth elastic arm 241 bending inward and then extending rearward from the front of the fourth fixed portion 240 and a fourth solder portion 242 extending outward from the bottom of the fourth fixed portion 240. A fourth contact portion 243 protrudes inward from the end of the fourth elastic arm 241. An elastic portion 244 connects with the end of the fourth contact portion 243. A fourth bump 245 is defined in the corresponding location of the fourth fixed portion 230.

The stationary terminal 25 has a fifth fixed portion 250 which is approximate rectangular configuration and an extension portion 251 extending upward from the back of the fifth fixed portion 250. A fifth elastic arm 252 extends forward from the front of the extension portion 251. A fifth contact portion 253 protrudes inward from the end of the fifth elastic arm 252.

The auxiliary terminal 26 has a thin and level board-shaped sixth fixed portion 260 extending transversely. A first connecting portion 261 extends upward from the end of the sixth fixed portion 260 which is near to fourth recess 113 and then forward. A second connecting portion 262 extends forward from the other end of the sixth fixed portion 260. The first connecting portion 261 has two first thorns 263 at the opposite sides thereof. The end of the second connecting portion 262 extends outward to form a sixth solder portion 264, and extends inward then bends upward to form an inserting portion 265. A plurality of second thorns 266 protrude from the two sides of the inserting portion 265.

Figure 6:
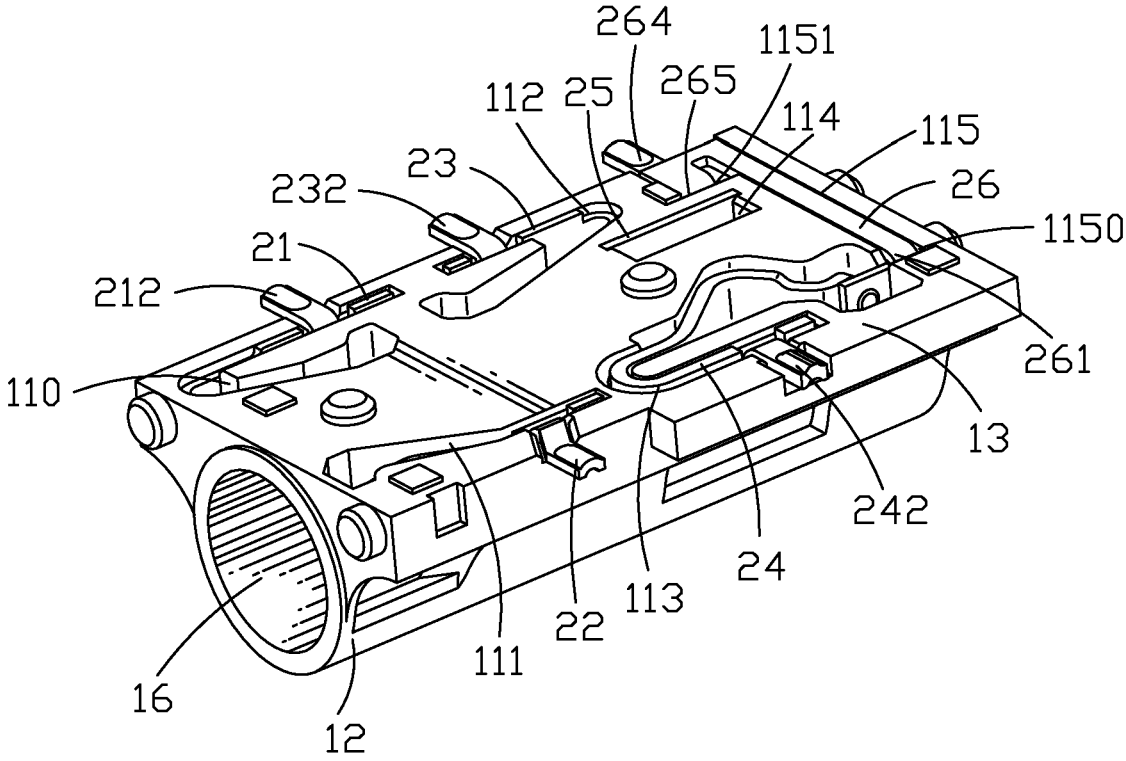
FIG. 6 is another angle perspective view of the audio jack connector shown in FIG. 1.

Please refer to FIGS. 4-6. In assembly, the first signal terminal 21, the second signal terminal 22, the third signal terminal 23, the fourth signal terminal 24, the stationary terminal 25 and the auxiliary terminal 26 are respectively received in the first recess 110, the second recess 111, the third recess 112, the fourth recess 113, the fifth recess 114 and the sixth recess 115. The solder portions respectively stretch out of the corresponding gaps 116, 117, 118, 119 to connect to the Printed Circuit Board. The sixth solder portion 264 stretches to the outside from the longitudinal portion of the sixth recess 115 to connect to the Printed Circuit Board. One part of the first connecting portion 261 is jammed in the first aperture 1150, the other part of the first connecting portion 261 projects into the fourth recess 113 and is near to the outside of the elastic portion 244 of the fourth signal terminal 24. The inserting portion 265 of the auxiliary terminal 26 is inserted into the second aperture 1151. The bumps 214, 224, 234, 245 and the thorns 263, 266 ensure the terminal 212, 222, 232, 242, 264 being stably received in the housing 10.

Figure 7:
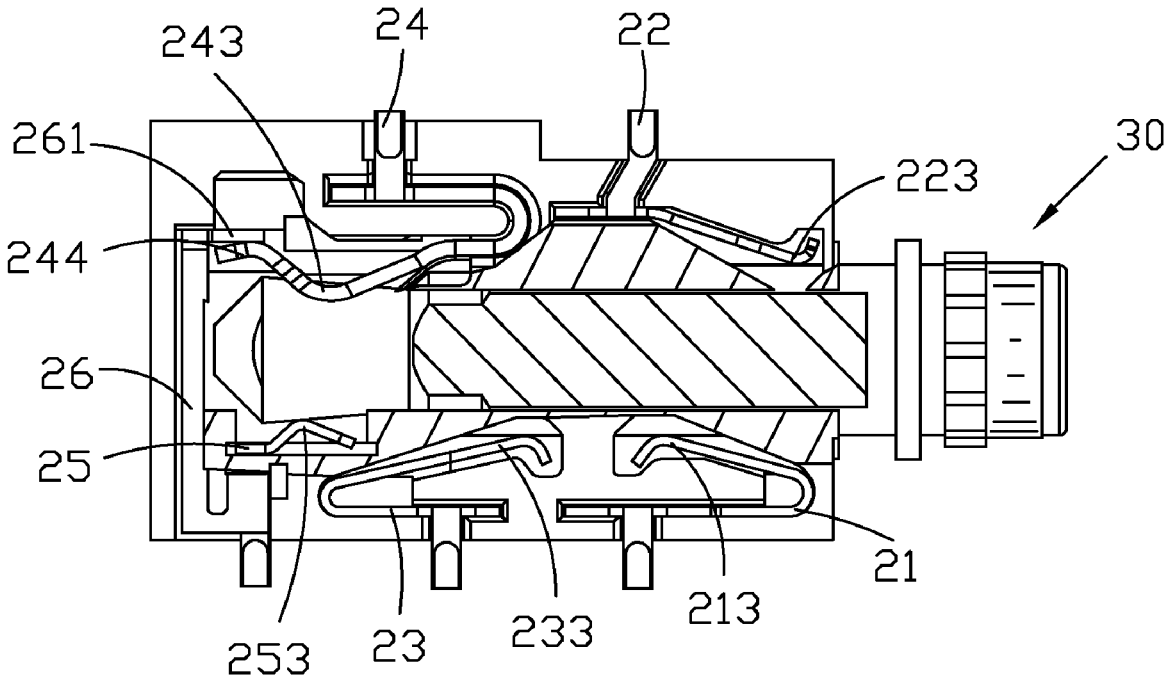
FIG. 7 is a cross-sectional view showing a plug inserting into the audio jack connector.

As shown in FIG. 7, when the audio jack connector 100 and a plug 30 mate with each other, the contact portions 213, 223, 233, 243, 253 respectively press against the plug 30. The plug 30 pushes the fourth contact portion 243 outward, then the fourth signal terminal 24 begins to change shape, the elastic portion 244 contacts and slides along the inside of the first connecting portion 261 of the auxiliary terminal 26, therefore, a reliable contacting force is formed therebetween.

As described above, the elastic portion 244 contacts and slides along the inside of the first connecting portion 261 of the auxiliary terminal 26 in the process of the insertion of the plug 30. Therefore, a reliable contacting force is formed between the elastic portion 244 and the first connecting portion 261, which provide more elastic force between the plug 30 and the fourth signal terminal 24.

What is claimed is:

1. An audio jack connector comprising:

a housing having a base and a cambered ridge extending upward from the middle of the base, an insertion hole extending inward from the front of the housing along an axis direction of the housing and being defined between the base and the cambered ridge, the bottom of the base defining at least one signal terminal recess and an auxiliary terminal recess, a first aperture being defined in the bottom of the auxiliary terminal recess and communicating with the signal terminal recess; and a terminal group having at least one signal terminal and an auxiliary terminal received in the signal terminal recess and the auxiliary terminal recess respectively, said signal terminal having a contact portion that projects into the insertion hole and an elastic portion extending from the end of the contact portion, said auxiliary terminal having a transverse fixed portion and a first connecting portion extending upward from the end of said fixed portion which is near to the signal terminal recess, wherein one part of the first connecting portion is jammed in the first aperture, the other part of the first connecting portion projects into the signal terminal recess and approaches the outside of the elastic portion for engagement with the elastic portion.

2. The audio jack connector as claimed in claim 1, wherein the signal terminal has a signal terminal fixed portion, an elastic arm bending inward and then extending rearward from the front of the signal terminal fixed portion and a signal terminal solder portion extending outward from the bottom of the signal terminal fixed portion, said contact portion protrudes inward from the end of the elastic arm.

3. The audio jack connector as claimed in claim 1, wherein the auxiliary terminal recess is defined in the rear of the housing and has is L-shaped, which includes a transverse portion and a longitudinal portion extending forward from one end of the transverse portion, the longitudinal portion communicates with the outside, the auxiliary terminal recess further includes a first aperture defined in one end of the bottom of the transverse portion opposite to the longitudinal portion and a second aperture defined in the bottom of the longitudinal portion.

4. The audio jack connector as claimed in claim 3, wherein the transverse portion is longer than the longitudinal portion.

5. The audio jack connector as claimed in claim 3, wherein the fixed portion is thin and level board-shaped and extends transversely, a second connecting portion extends forward from the other end of the fixed portion, the end of the second connecting portion extends outward to form a solder portion stretching to the outside from the longitudinal portion and extends inward then bends upward to form an inserting portion inserted in the second aperture.

* * * * *